US010921026B2

(12) United States Patent
Maeda et al.

(10) Patent No.: US 10,921,026 B2
(45) Date of Patent: Feb. 16, 2021

(54) HEATING HEAT-SOURCE APPARATUS AND CONTROL METHOD THEREOF

(71) Applicant: NORITZ CORPORATION, Hyogo (JP)

(72) Inventors: Takahiro Maeda, Hyogo (JP); Yoshiro Nishiyama, Hyogo (JP); Toshiya Tatsumura, Hyogo (JP); Yoshikazu Kato, Hyogo (JP); Yuki Nakajima, Hyogo (JP); Takuto Matsuoka, Hyogo (JP); Hidetsugu Okada, Hyogo (JP); Isao Aoki, Hyogo (JP); Sachiko Tachibana, Hyogo (JP); Masanori Yamashita, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 343 days.

(21) Appl. No.: 15/983,115

(22) Filed: May 18, 2018

(65) Prior Publication Data

US 2018/0347856 A1 Dec. 6, 2018

(30) Foreign Application Priority Data

Jun. 2, 2017 (JP) ..... 2017-109708

(51) Int. Cl.
*F24H 9/20* (2006.01)
*F24H 9/12* (2006.01)
(Continued)

(52) U.S. Cl.
CPC ..... *F24H 9/2035* (2013.01); *F24D 19/1066* (2013.01); *F24H 1/145* (2013.01); *F24H 8/006* (2013.01); *F24H 9/128* (2013.01)

(58) Field of Classification Search
CPC ..... F24H 9/2035
See application file for complete search history.

(56) References Cited

U.S. PATENT DOCUMENTS

2010/0206869 A1* 8/2010 Nelson ..... F24H 9/2007 219/494
2017/0231032 A1* 8/2017 Kodama ..... F24C 5/16

FOREIGN PATENT DOCUMENTS

JP S57125911 8/1982
JP 60026241 A * 2/1985 ..... F24H 9/2035
JP 3856353 B2 * 12/2006

OTHER PUBLICATIONS

JP60026241A—machine translation (Year: 1985).*

* cited by examiner

*Primary Examiner* — Nathaniel Herzfeld
(74) *Attorney, Agent, or Firm* — JCIPRNET

(57) ABSTRACT

In a heating heat-source apparatus having input circuits configured to receive pieces of mutually independent heating demand information, an abnormality related to an operation for setting one input circuit among the input circuits to a use state is detected and reported. Input circuits receive heating demand information. An operation part receives an operation for setting one input circuit of the input circuits to a use state. A CPU receives heating demand information transmitted from the input circuit in the use state while receiving specified information for specifying the input circuit in the use state from the operation part. Each piece of heating demand information is voltage information having a predetermined voltage range. The CPU reports an abnormality related to an operation for setting when voltage information transmitted from the input circuit in the use state deviate from a voltage range specified in the specified information.

7 Claims, 7 Drawing Sheets

(51) Int. Cl.

| | |
|---|---|
| ***F24H 8/00*** | (2006.01) |
| ***F24H 1/14*** | (2006.01) |
| ***F24D 19/10*** | (2006.01) |

| Setting value | Input terminal connecting state | |
|---|---|---|
| 1 | dc | Non-connection |
| 2 | OS | Connection to external temperature sensor |
| 3 | HC | Connection to heating demand connector |

| Pattern | | | |
|---|---|---|---|
| Non-connection | Connection to external air temperature | Connection to heating demand connector | Connection to external air temperature sensor & heating demand |
| VOS#=VCC | VL1≦VOS#<VCC | VOS#=VCC | VL1≦VOS#<VCC |
| VHC#=VCC | VHC#=VCC | VL2≦VHC#<VCC | VL2≦VHC#<VCC |

FIG. 6

| | Operation on | | | Operation off |
|---|---|---|---|---|
| | 1(dc) | 2(OS) | 3(HC) | ANY |
| Non-connection | Flickering | Flickering + error | Flickering + error | Lights-off |
| Connection to external air temperature sensor | Flickering | Lighting | Flickering or lighting | Lights-off |
| Connection to heating demand connector | Flickering | Flickering or lighting | Flickering or lighting | Lights-off |
| Connection to external air temperature sensor and heating demand connector | Flickering | Lighting | Flickering or lighting | Lights-off |

FIG. 7

HEATING HEAT-SOURCE APPARATUS AND CONTROL METHOD THEREOF

CROSS-REFERENCE TO RELATED APPLICATION

This application claims the benefit of Japanese Application Serial No. 2017-109708, filed on Jun. 2, 2017. The entirety of the above-mentioned patent application is hereby incorporated by reference herein and made a part of this specification.

BACKGROUND

Technical Field

The disclosure relates to a heating heat-source apparatus and a control method thereof, and more particularly, to a heating heat-source apparatus having a plurality of input circuits configured to receive a plurality of pieces of mutually independent heating demand information, and a control method thereof.

Description of Related Art

As an embodiment of a heating heat-source apparatus, a heating heat-source apparatus having both of a heating function of circulating a thermal medium through a circulating path formed between a heating terminal and the apparatus and a hot water supplying function obtained by causing a bypass path including a heat exchanger for supplying hot water to branch off from the circulating path is used. In the above-mentioned heating heat-source apparatus, as the thermal medium is partially circulated through a circulating path and a bypass path, the heating function and the hot water supplying function can be simultaneously exhibited.

As another embodiment of a heating heat-source apparatus, a combination boiler in which a boiler configured to heat a thermal medium and a water heater configured to heat tap water are combined is also used. In the combination boiler, the thermal medium and the tap water are heated by a single heat source. For example, in Japanese Utility Model Publication No. S57-125911 (Patent Document 1), a centralized control device of a central heating system configured to collectively control operations of a boiler that generates hot water, a circulating pump that circulates the hot water and a plurality of heat radiating machines is disclosed.

In the above-mentioned heating heat-source apparatus, a plurality of input circuits configured to receive a plurality of pieces of mutually independent heating demand information are also provided. In the heating heat-source apparatus, one input circuit among the plurality of input circuits is set to a use state. Then, a heating structure configured to heat a thermal medium is controlled according to the heating demand information received by the one input circuit set to the use state.

In the heating heat-source apparatus, an operation of setting one input circuit among the plurality of input circuits to a use state is generally performed by a builder. In the operation, an abnormality in which heating demand information is not input to the input circuit that should have been set to the use state may occur. However, since there is no means to detect and report such an abnormality, there is a problem that a user has no way to recognize the abnormality.

PATENT DOCUMENTS

[Patent Document 1] Japanese Utility Model Publication No. S57-125911

SUMMARY

The disclosure is directed to providing a heating heat-source apparatus having a plurality of input circuits configured to receive a plurality of pieces of mutually independent heating demand information, and configured to detect and report an abnormality related to an operation of setting one input circuit among the plurality of input circuits to a use state.

In an embodiment of the disclosure, a heating heat-source apparatus includes a heating structure configured to heat a thermal medium, a heating circulating path, a plurality of input circuits, a setting part, a control part and a reporting part. The heating circulating path is configured to circulate the thermal medium heated by the heating structure between a heating terminal and the heating heat-source apparatus upon performance of a heating operation. The plurality of input circuits are configured to receive a plurality of pieces of mutually independent heating demand information. The setting part is configured to set one input circuit of the plurality of input circuits to a use state. The control part is configured to control the heating structure on the basis of heating demand information transmitted from the input circuit in the use state while receiving specified information for specifying the input circuit in the use state set by the setting part. Each of the plurality of pieces of heating demand information is provided to the corresponding input circuit as voltage information having a predetermined voltage range. Each of the plurality of input circuits is configured to output the voltage value based on the provided voltage information to the control part. The control part reports an abnormality using the reporting part when the voltage value output from the input circuit in the use state deviates from an output voltage range output by the input circuit specified in the specified information.

BRIEF DESCRIPTION OF THE DRAWINGS

FIG. 6 is a view for explaining a pattern detected by the CPU.

FIG. 7 is a view for explaining an aspect of a report of a diagnostic result by the CPU.

DESCRIPTION OF THE EMBODIMENTS

Figure 1:
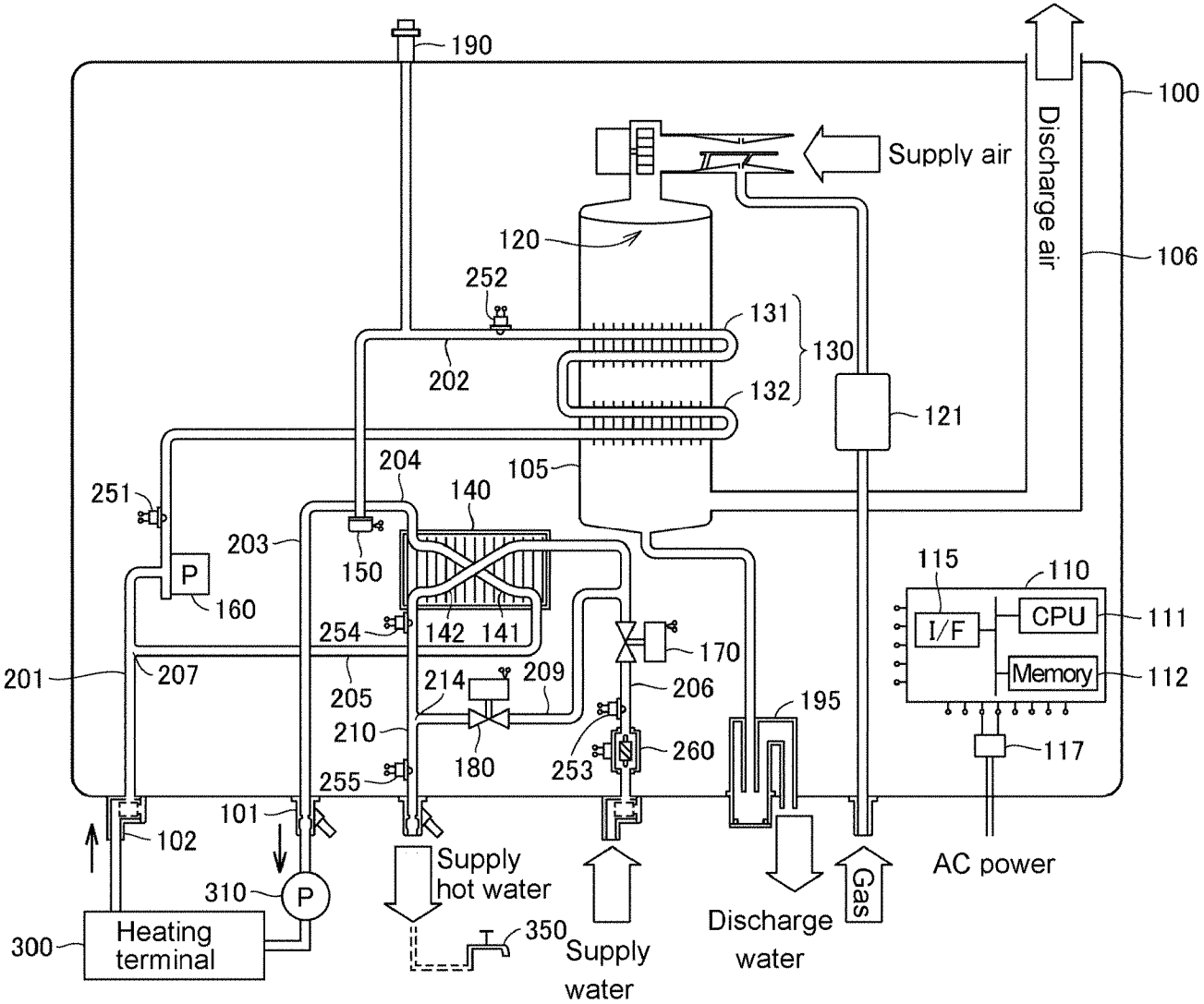
FIG. 1 is a block diagram for explaining a configuration of a heating heat-source apparatus according to Embodiment 1.

According to the heating heat-source apparatus, in an operation of setting one input circuit among the plurality of input circuits to the use state, when the abnormality in which the heating demand information is not input to the input circuit set to the use state occurs, the abnormality can be detected and reported. Accordingly, it is possible for a user to recognize the abnormality.

In the heating heat-source apparatus, the abnormality includes an abnormality in which the heating demand information is not input to the input circuit in the use state; and an abnormality in which the input circuit in the use state is erroneously set by the setting part.

According to the above-mentioned configuration, the abnormality that may occur in the operation of setting the one input circuit among the plurality of input circuits to the use state can be detected and reported.

In the heating heat-source apparatus, the input circuit includes a conversion circuit configured to convert the voltage information into a voltage that is able to be input to the control part and output the converted voltage to the control part. The conversion circuit is configured such that the voltage range of the voltage information is reduced to be narrower than a voltage range that is able to be input to the control part. Further, when the voltage information is not input, in the conversion circuit, a voltage value inside a voltage range that is able to be input to the control part and outside the output voltage range is output to the control part.

According to the above-mentioned configuration, the control part can determine whether the voltage information is input to the input circuit on the basis of the voltage value of the voltage information provided from the input circuit.

In the heating heat-source apparatus, the conversion circuit is configured such that an upper limit value of the voltage range of the voltage information is converted into a voltage value that is lower than the upper limit value of the voltage range that is able to be input to the control part. Further, when the voltage information is not input, in the conversion circuit, a voltage value equal to the upper limit value of the voltage range that is able to be input to the control part is output to the control part.

According to the above-mentioned configuration, the control part can determine whether the voltage information is input to the input circuit on the basis of the voltage value of the voltage information provided from the input circuit.

In the heating heat-source apparatus, the conversion circuit is configured such that a lower limit value of the voltage range of the voltage information is converted into a voltage value higher than the lower limit value of the voltage range that is able to be input to the control part. Further, when the voltage information is not input, in the conversion circuit, a voltage value equal to the lower limit value of the voltage range that is able to be input to the control part is output to the control part.

According to the above-mentioned configuration, the control part can determine whether the voltage information is input to the input circuit on the basis of the voltage value of the voltage information provided from the input circuit.

In another embodiment of the disclosure, in a control method of a heating heat-source apparatus, the heating heat-source apparatus includes a heating structure configured to heat a thermal medium, a heating circulating path, a plurality of input circuits and a setting part. The heating circulating path is configured to circulate the thermal medium heated by the heating structure between a heating terminal and the heating heat-source apparatus upon performance of a heating operation. The plurality of input circuits are configured to receive a plurality of pieces of mutually independent heating demand information. The setting part is configured to set one input circuit among the plurality of input circuits to a use state. Each of the plurality of pieces of heating demand information is provided to the corresponding input circuit as voltage information having a predetermined voltage range. Each of the plurality of input circuits is configured to output the voltage value based on the provided voltage information to the control part. The control method includes receiving the voltage value transmitted from the input circuit in the use state; receiving specified information for specifying the input circuit in the use state from the setting part; and reporting an abnormality when the voltage value transmitted from the input circuit in the use state deviates from an output voltage range output by the input circuit specified in the specified information.

According to the control method of the heating heat-source apparatus, in an operation of setting one input circuit among the plurality of input circuits to the use state, when the abnormality in which the heating demand information is not input to the input circuit set to the use state occurs, the abnormality can be detected and reported. Accordingly, it is possible for a user to recognize the abnormality.

According to the disclosure, in the heating heat-source apparatus having the plurality of input circuit configured to receive the plurality of pieces of mutually independent heating demand information, the abnormality related to the operation of setting the one input circuit among the plurality of input circuits to the use state can be detected and reported.

Hereinafter, an embodiment of the disclosure will be described in detail with reference to the accompanying drawings. Further, hereinafter, the same or corresponding components in the drawings are designated by the same reference numbers and description thereof will generally not be repeated.

Embodiment 1

FIG. 1 is a block diagram for explaining a configuration of a heating heat-source apparatus according to Embodiment 1.

Referring to FIG. 1, a heating heat-source apparatus 100 according to Embodiment 1 includes an output terminal 101 and an input terminal 102 connected to a heating terminal 300, an inflow pipe 206 through which cold water such as tap water or the like is introduced, and a tap pipe 210 configured to supply hot water to a hot water tap 350 or the like. In the heating heat-source apparatus 100, a heating function is realized by supplying a thermal medium (high temperature water) to the heating terminal 300 via the output terminal 101 and the input terminal 102. Further, a hot water supplying function from the tap pipe 210 is realized by heating the cold water introduced to the inflow pipe 206 through heat exchange with the thermal medium.

First, a configuration of the heating heat-source apparatus 100 related to the heating function will be mainly described. The heating heat-source apparatus 100 further includes a storage water heater body 105 in which a combustion burner 120 and a heat exchanger 130 are installed, an exhaust pipe 106, a controller 110, a heat exchanger 140 for supplying hot water, a distributing valve 150, a circulating pump 160 and pipelines 201 to 205.

The combustion burner 120 receives supply of fuel represented by a gas and generates a heat quantity through combustion of the fuel. The fuel is supplied to the combustion burner 120 via a flow rate control valve 121. A gas flow rate supplied to the combustion burner 120, i.e., the heat quantity generated in the combustion burner 120 can be controlled by adjusting an opening angle of the flow rate control valve 121.

The heat exchanger 130 has a primary heat exchanger 131 configured mainly to heat a fluid using sensible heat through fuel combustion in the combustion burner 120, and a secondary heat exchanger 132 configured mainly to heat fluid using latent heat of an exhaust gas through fuel combustion.

The combusted exhaust gas generated through combustion in the combustion burner 120 is discharged to the outside of the heating heat-source apparatus 100 via the exhaust pipe 106. In addition, in the secondary heat exchanger 132, acidic water (drainage) generated by cooling and condensing the combusted exhaust gas through heat exchange for recovering latent heat is collected in a drainage tank 195 after neutralization, and discharged to the outside of the heating heat-source apparatus 100.

The input terminal 102 into which the thermal medium passing through the heating terminal 300 is input is connected to an input side of the secondary heat exchanger 132 by the pipeline 201. An output side of the primary heat exchanger 131 is connected to the pipeline 202. The pipeline 202 is connected to the pipelines 203 and 204 via the distributing valve 150. The pipeline 203 is connected to the output terminal 101 configured to output the thermal medium to the heating terminal 300. The pipeline 204 is connected to an input side of a primary-side path 141 of the heat exchanger 140 for supplying hot water. The output side of the primary-side path 141 of the heat exchanger 140 for supplying hot water is connected to the pipeline 201 by the pipeline 205.

An opening angle of the distributing valve 150 is controlled by the controller 110. A ratio between a flow rate of a path from the pipeline 202 to the pipeline 203 and a flow rate of a path from the pipeline 202 to the pipeline 204 can be controlled according to the opening angle of the distributing valve 150.

The heating terminal 300 and a heating pump 310 are connected between the output terminal 101 and the input terminal 102. As the heating pump 310 is operated, "a heating circulating path" configured to circulate a thermal medium between the heating terminal 300 and the heating heat-source apparatus 100 is formed in the heating heat-source apparatus 100 between the output terminal 101 and the input terminal 102. The heating circulating path includes the pipeline 201, the heat exchanger 130, the pipeline 202, the distributing valve 150 and the pipeline 203. For example, the thermal medium is high temperature water heated by a heat quantity generated by the combustion burner 120 in the heat exchanger 130. That is, the combustion burner 120 and the heat exchanger 130 correspond to an example of "the heating structure."

As the thermal medium is supplied to the heating terminal 300, a space (indoors) in which the heating terminal 300 is disposed can be heated. That is, the heating heat-source apparatus 100 can realize the heating function by heating the thermal medium that circulates the heating circulating path formed by an operation of the heating pump 310.

A pressure relief valve 190 is further installed in the heating circulating path. In addition, while not shown, a circuit configured to supply tap water or the like when the thermal medium is further reduced is connected to the heating circulating path.

As the thermal medium is introduced into the pipeline 204 by the distributing valve 150, a bypass path branched off from the heating circulating path can be formed with respect to the thermal medium heated by the heat exchanger 130. The bypass path includes the pipeline 204, the primary-side path 141 of the heat exchanger 140 for supplying hot water, and the pipeline 205. The thermal medium that circulates through the bypass path joins the heating circulating path at a connecting point 207 of the pipelines 201 and 205 after circulating the heat exchanger 140 for supplying hot water (the primary-side path 141) without passing through the heating terminal 300.

The circulating pump 160 is disposed downstream from the connecting point 207 (on the side of the heat exchanger 130) in the pipeline 201. Accordingly, if the circulating pump 160 is operated, even when the heating circulating path is not formed by the operation of the heating pump 310, the bypass path configured to circulate the thermal medium through the heat exchanger 130 and the heat exchanger 140 for supplying hot water can be formed.

A ratio between a supply flow rate to the heating circulating path and a supply flow rate to the bypass path with respect to the thermal medium heated by the heat exchanger 130 can be controlled according to an opening angle of the distributing valve 150. Specifically, provided that a ratio of the flow rate supplied to the bypass path to the total flow rate of the thermal medium output from the heat exchanger 130 is a distribution factor kd, the distribution factor kd is controlled from kd=0 (i.e., the total amount of thermal medium circulates through the heating circulating path) to kd=1.0 (i.e., the total amount of thermal medium circulates through the bypass path) ($0 \leq kd \leq 1.0$).

Next, a configuration related to the hot water supplying function of the heating heat-source apparatus 100 and connected to a secondary-side path 142 of the heat exchanger 140 for supplying hot water will be described.

The heating heat-source apparatus 100 includes a bypass pipe 209, a flow rate regulator valve 170 and a bypass flow rate valve 180, in addition to the inflow pipe 206 and the tap pipe 210.

When the hot water tap 350 is opened, cold water is introduced from the inflow pipe 206 due to a water pressure of tap water or the like. The inflow pipe 206 is connected to an input side of the secondary-side path 142 of the heat exchanger 140 for supplying hot water. The tap pipe 210 is connected to an output side of the secondary-side path 142 of the heat exchanger 140 for supplying hot water. Cold water that circulates through the secondary-side path 142 is heated in the heat exchanger 140 for supplying hot water by a heat quantity of the thermal medium that circulates through the primary-side path 141. As a result, high temperature water is output from the secondary-side path 142 to the tap pipe 210.

The bypass pipe 209 is disposed to form the bypass path of the heat exchanger 140 for supplying hot water between the inflow pipe 206 and the tap pipe 210. A joining point 214 with the bypass pipe 209 is formed in the tap pipe 210. Then, hot water having an appropriate temperature obtained by mixing the high temperature water heated by the heat exchanger 140 for supplying hot water and the cold water passing through the bypass pipe 209 is supplied from the tap pipe 210 to the hot water tap 350 or the like.

The bypass flow rate valve 180 is disposed in the bypass pipe 209. A flow rate ratio of the bypass pipe 209 with respect to an incoming water flow rate into the inflow pipe 206, i.e., a mixing ratio between the high temperature water and the cold water, is controlled according to an opening angle of the bypass flow rate valve 180.

The flow rate regulator valve 170 may be disposed in the inflow pipe 206. For example, during a period in which a heating capacity immediately after the start of supply of hot water is insufficient, a decrease in tapping temperature can be prevented by controlling an opening angle of the flow rate regulator valve 170 to reduce the tapping flow rate. In addition, even other than the time immediately after the start of supply of hot water, in order to discharge the hot water according to a set temperature for supplying hot water upon a high flow rate, the tapping flow rate can be reduced through the opening angle control of the flow rate regulator valve 170.

A temperature sensor 251 configured to detect an input temperature Tin of a thermal medium to the heat exchanger 130 is installed in the pipeline 201 of the heating circulating path. A temperature sensor 252 configured to detect an output temperature Thm of a thermal medium heated by the heat exchanger 130 is disposed in the pipeline 202. Further, a temperature sensor 253 related to a hot water supplying function and configured to detect a temperature Tw of cold water introduced into the inflow pipe 206 is installed. A temperature sensor 254 configured to detect a temperature Th of high temperature water is disposed on the output side of the secondary-side path 142 of the heat exchanger 140 for supplying hot water. Further, a temperature sensor 255 configured to detect a tapping temperature To after mixing of the high temperature water and the cold water is disposed downstream from the joining point 214 of the tap pipe 210.

The controller 110 is operated to receive a power supply voltage (for example, DC 15 V) from a power supply circuit 117. The power supply circuit 117 converts power from an external power supply (for example, a commercial AC power supply) of the heating heat-source apparatus 100 into a power supply voltage.

The controller 110 has a central processing unit (CPU) 111, a memory 112 and an interface 115. The controller 110 controls operations of various components such that the heating heat-source apparatus 100 is operated according to an operation command from a user by performing a program that is previously stored in the memory 112.

Figure 2:
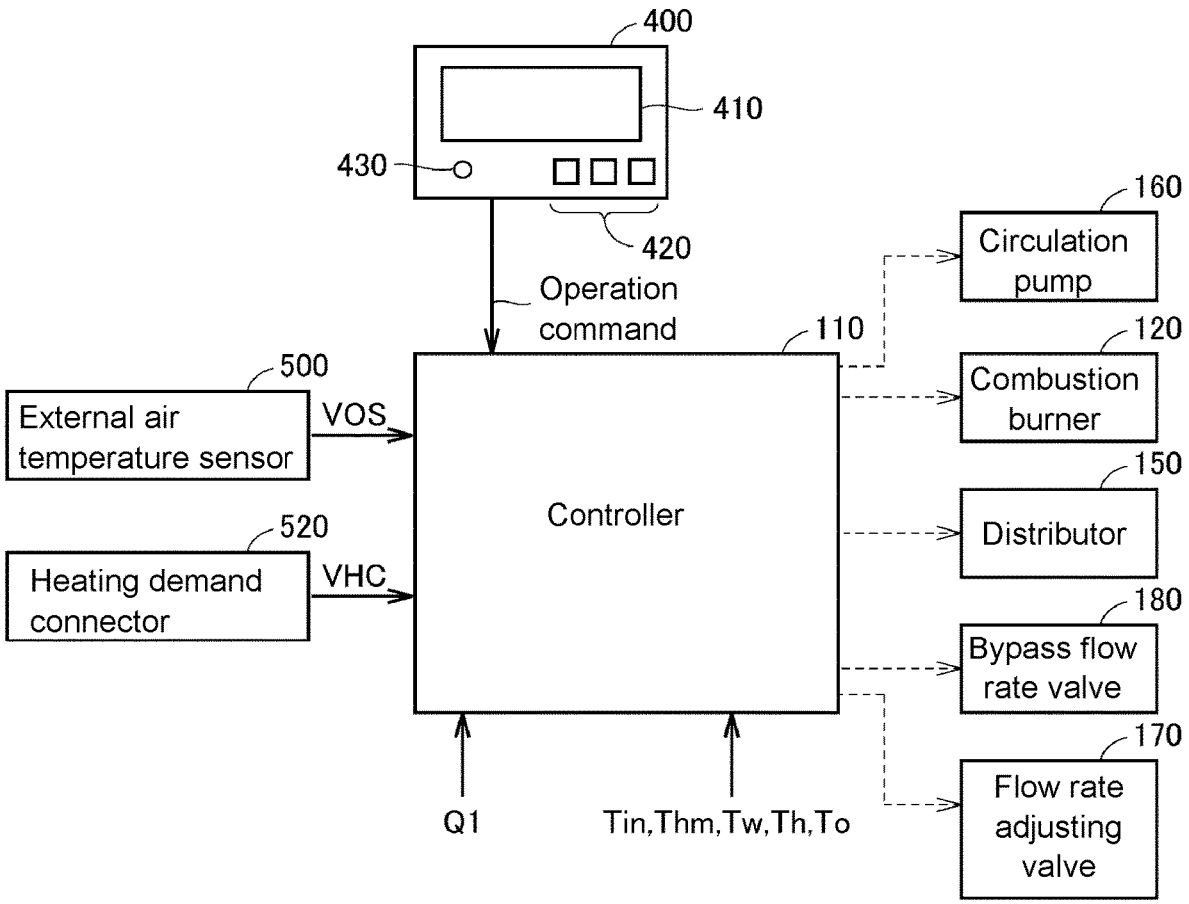
FIG. 2 is a functional block diagram for explaining operation control of the heating heat-source apparatus by a controller.

FIG. 2 shows a functional block diagram for explaining operation control of the heating heat-source apparatus 100 by the controller 110.

Referring to FIG. 2, the controller 110 is connected to a remote controller 400 of the heating heat-source apparatus 100 by a communication line (for example, a two-core communication line). The remote controller 400 and the controller 110 are in bidirectional communication with each other.

A display part 410, an operation part 420 and a light emitting body 430 are installed in the remote controller 400. A user can input an operation command of the heating heat-source apparatus 100 using the operation part 420. The operation command includes an operation on/off command of the heating heat-source apparatus 100, a set temperature for supplying hot water in a hot water supplying operation, and a heating capacity in a heating operation.

The display part 410 may be constituted by a liquid crystal panel. The display part 410 can visually display information showing an operating state of the heating heat-source apparatus 100, content of the set operation command, or the like. Alternatively, a part or the entirety of the operation part 420 may also be configured using a partial region of the display part 410 constituted by a touch panel.

The light emitting body 430 may be constituted by at least one light emitting diode (LED). As lighting, lights-out or flickering of the at least one LED is performed, and the light emitting body 430 can realize a plurality of lighting patterns. The light emitting body 430 can visually display information showing a connection state between the controller 110, an ambient temperature sensor 500 and a heating demand connector 520, which will be described below, using the plurality of lighting patterns.

An operation command input to the remote controller 400 is input to the controller 110. Further, the input temperature Tin and the output temperature Thm of the thermal medium detected by the temperature sensors 251 to 255, and the cold water temperature Tw, the high temperature water temperature Th and the tapping temperature To are input. Further, a flow rate detection value Q1 detected by a flow rate sensor 260 is input to the controller 110.

Further, heating demand information is input from the ambient temperature sensor 500 or the heating demand connector 520 installed outside the heating heat-source apparatus 100 to the controller 110.

The ambient temperature sensor (outdoor sensor) 500 is a sensor configured to detect an air temperature outside a space (a room or the like) in which the heating terminal 300 is installed. The ambient temperature sensor 500 outputs a signal showing the detected ambient temperature to the controller 110 as heating demand information. The heating demand information is voltage information VOS having a predetermined voltage range.

The heating demand connector (heat demand connection) 520 is an apparatus for controlling a heating temperature of a space in which the heating terminal 300 is installed. The heating demand connector 520 is configured to adjust a target value of a heating temperature according to a variation in a room temperature of the space in which the heating terminal 300 is installed, an ambient temperature, or the like. For example, when the ambient temperature is low, for example, during winter or the like, while the heating demand connector 520 increases the target value of the heating temperature, when the ambient temperature is high, for example, during summer or the like, the heating demand connector 520 decreases the target value of the heating temperature. The heating demand connector 520 outputs the target value of the heating temperature to the controller 110 as the heating demand information. The heating demand information is voltage information VHC having a predetermined voltage range. The voltage information VHC is configured such that the voltage value is increased as the target value of the heating temperature is increased.

Conventionally, any one of the ambient temperature sensor 500 and the heating demand connector 520 is connected to the controller 110 by a communication line. Accordingly, heating demand information (voltage information) is input to the controller 110 from one of the ambient temperature sensor 500 and the heating demand connector 520 connected to the controller 110.

Since the heating heat-source apparatus 100 is operated according to the operation command and the heating demand information, the controller 110 outputs a signal for controlling an operation and stoppage of the circulating pump 160, a signal for controlling an opening angle of the distributing valve 150, a signal for controlling an opening angle of the bypass flow rate valve 180, a signal for controlling an opening angle of the flow rate regulator valve 170, and a signal for controlling a heat quantity generated in the combustion burner 120 (for example, an opening angle control signal of the flow rate control valve 121). These signals are output from the controller 110 via the interface 115 according to the control-processed result in the CPU 111.

Figures 3, 4:
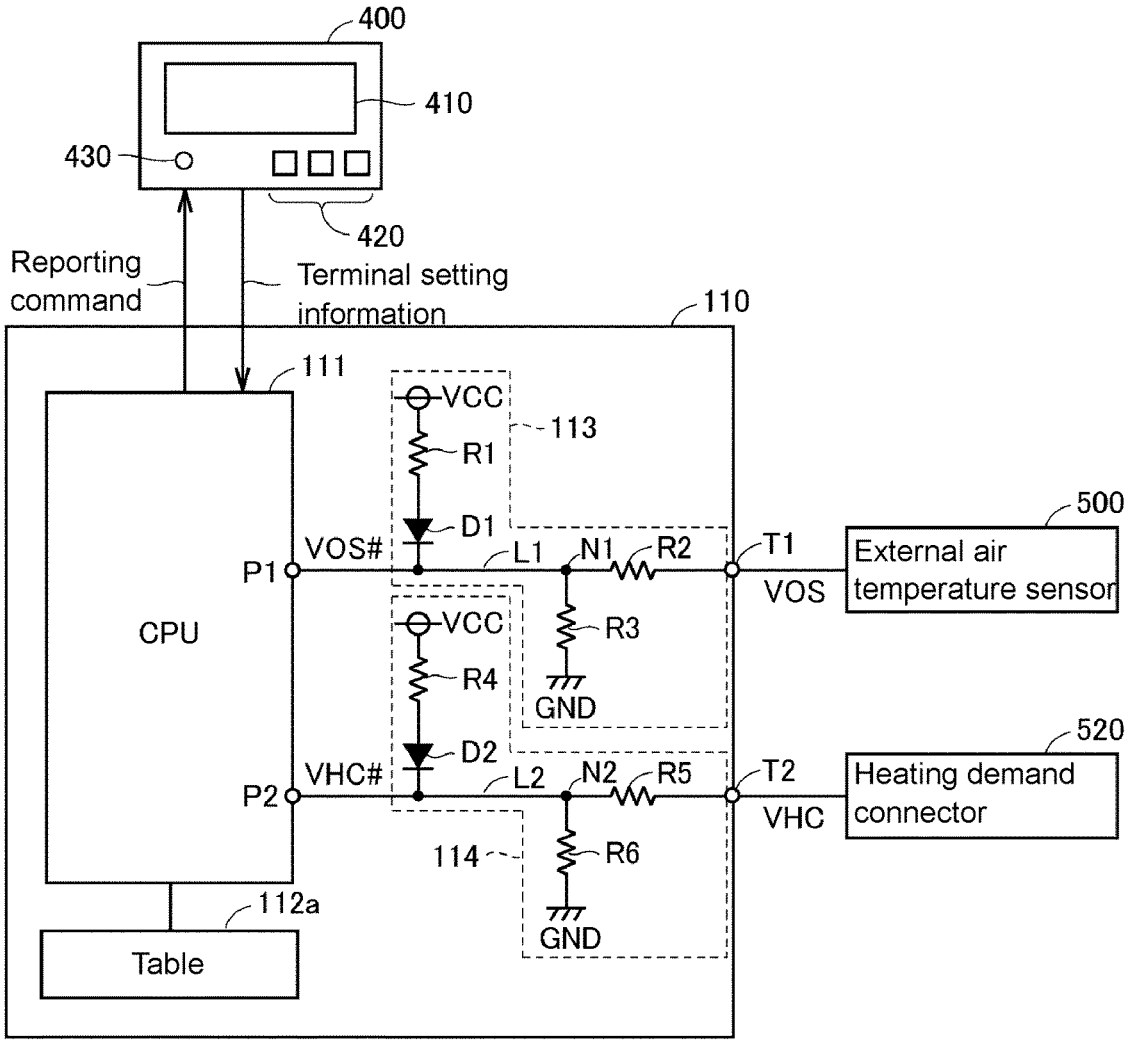
FIG. 3 is a schematic circuit configuration view of the controller shown in FIG. 2.
FIG. 4 is a view showing an input example of terminal setting information.

FIG. 3 shows a schematic circuit configuration of the controller 110 shown in FIG. 2.

Referring to FIG. 3, a power supply wiring supplies a power supply voltage VCC to a circuit or an element of the controller 110 including the CPU 111. The power supply voltage VCC is, for example, 5 V. The CPU 111 is operated by receiving the power supply voltage VCC from the power supply wiring.

The controller 110 has an input circuit 113 configured to receive heating demand information from the ambient temperature sensor 500, and an input circuit 114 configured to receive heating demand information from the heating demand connector 520.

The input circuit 113 has an input terminal T1, a wiring L1, resistance elements R1 to R3, and a diode D1. The input terminal T1 is connected to the ambient temperature sensor 500 via a communication line. The resistance elements R2 and R3 are serially connected between the input terminal T1 and a grounding voltage GND. A node N1 between the resistance element R2 and the resistance element R3 is electrically connected to the input port P1 of the CPU 111 via the wiring L1. The resistance element R1 and the diode D1 are serially connected between the power supply voltage VCC and the wiring L1.

As shown in FIG. 3, when the ambient temperature sensor 500 is connected to the input terminal T1, the ambient temperature sensor 500 inputs the voltage information VOS to the input terminal T1 as the heating demand information. The voltage information VOS has a predetermined voltage range. The resistance elements R2 and R3 output a voltage VOS # obtained by dividing the voltage information VOS to the node N1. The divided voltage VOS # is input to an input port P1 of the CPU 111. Further, hereinafter, reference numerals of the resistance elements are also used as electrical resistance values. Accordingly, the voltage (the divided voltage) VOS # input to the input port P1 is represented by VOS #=VOS×R3/(R2+R3).

In the input circuit 113, the voltage information VOS provided from the ambient temperature sensor 500 is converted into the voltage VOS # that can be input to the CPU 111, and output to the input port P1 of the CPU 111. The resistance elements R2 and R3 constitute a conversion circuit configured to convert the voltage information VOS into the voltage VOS #.

The input circuit 114 has an input terminal T2, a wiring L2, resistance elements R4 to R6, and a diode D2. The input terminal T2 is connected to the heating demand connector 520 via a communication line. The resistance elements R5 and R6 are serially connected between the input terminal T2 and the grounding voltage GND. A node N2 between the resistance element R5 and the resistance element R6 is electrically connected to an input port P2 of the CPU 111 via the wiring L2. The resistance element R4 and the diode D2 are serially connected between the power supply voltage VCC and the wiring L2.

As shown in FIG. 3, when the heating demand connector 520 is connected to the input terminal T2, the heating demand connector 520 inputs the voltage information VHC to the input terminal T2 as the heating demand information. The voltage information VHC has a predetermined voltage range. The resistance elements R5 and R6 output a voltage VHC # obtained by dividing the voltage information VHC to the node N2. The divided voltage VHC is input to the input port P2 of the CPU 111. The voltage (divided voltage) VHC input to the input port P2 is represented by VHC #=VHC×R6/(R5+R6).

In the input circuit 114, the voltage information VHC provided from the heating demand connector 520 is converted into the voltage VHC # that can be input to the CPU 111, and output to the input port P2. The resistance elements R5 and R6 constitute a conversion circuit configured to convert the voltage information VHC into the voltage VHC #.

In this way, the controller 110 has the input circuits 113 and 114 configured to receive the heating demand information (the voltage information VOS and VHC) from the ambient temperature sensor 500 and the heating demand connector 520. However, as described above, only one of the ambient temperature sensor 500 and the heating demand connector 520 is basically connected to the controller 110. Accordingly, for example, when the ambient temperature sensor 500 is connected to the input terminal T1 of the input circuit 113, the heating demand connector 520 is not connected to the input terminal T2 of the input circuit 114. In this case, the CPU 111 controls operations of the components on the basis of the voltage information VOS (VOS #) of the ambient temperature sensor 500 input to the input port P1.

Meanwhile, when the heating demand connector 520 is connected to the input terminal T2 of the input circuit 114, the ambient temperature sensor 500 is not connected to the input terminal T1 of the input circuit 114. In this case, the CPU 111 controls operation of the components on the basis of the voltage information VHC (VHC #) of the heating demand connector 520 input to the input port P2.

Here, in the heating heat-source apparatus 100, when work of attaching the ambient temperature sensor 500 or the heating demand connector 520 to the controller 110 is performed, in order to show the controller 110 which of the ambient temperature sensor 500 and the heating demand connector 520 is attached, in other words, which of the input circuits 113 and 114 is in the use state, an operation of setting one input circuit of the input circuits 113 and 114 to the use state is performed by a builder. The operation can be performed using, for example, the operation part 420 installed in the remote controller 400. The operation part 420 corresponds to "a setting part" in the disclosure.

Specifically, a builder can input specified information specifying the input circuit set to the use state using the operation part 420 of the remote controller 400. The specified information corresponds to information showing connection states of the input terminals T1 and T2. In the following description, the information showing the connection states of the input terminals T1 and T2 is also referred to as "terminal setting information."

FIG. 4 shows an input example of terminal setting information. In the example of FIG. 4, the terminal setting information is constituted by three setting values.

Specifically, a setting value "1" shows "dc (disconnection)." "dc" represents a state in which the ambient temperature sensor 500 is not connected to the input terminal T1 and the heating demand connector 520 is not connected to the input terminal T2.

A setting value "2" shows "OS (an outdoor sensor)." "OS" represents a state in which the ambient temperature sensor 500 is connected to the input terminal T1.

A setting value "3" shows "HC (heat demand connection)." "HC" represents a state in which the heating demand connector 520 is connected to the input terminal T2.

A builder inputs any one of the three setting values using the operation part 420 of the remote controller 400 upon finishing the attachment work. Further, a default value of the setting value is "1." That is, when the attachment work of the ambient temperature sensor 500 and the heating demand connector 520 is not performed, the setting value is held at "1." The terminal setting information shown in FIG. 4 is transmitted from the remote controller 400 to the CPU 111 of the controller 110. The terminal setting information transmitted to the CPU 111 is stored in the memory 112.

Returning to FIG. 3, when power of the heating heat-source apparatus 100 is input and the controller 110 is started, the CPU 111 diagnoses whether there is an abnormality related to an operation of setting the input circuit that is in the above-mentioned use state, on the basis of the terminal setting information held at the memory 112 and the voltage information VOS # and VHC # input to the input ports P1 and P2.

Further, the abnormality related to the operation of setting the input circuit that is in the use state includes an abnormality in which the heating demand information is not input to the input circuit in the use state, and an abnormality in which the input circuit in the use state is erroneously set to the operation part 420.

The abnormality in which the heating demand information is not input to the input circuit in the use state may occur, for example, (i) when a builder inputs the original setting value "1" but forgets to connect the ambient temperature sensor 500 to the input terminal T1 of the input circuit 113 or when the ambient temperature sensor 500 is erroneously connected to the input terminal T2 of the input circuit 114 different from the input circuit 113, and (ii) when a communication line that connects the input terminal T1 and the ambient temperature sensor 500 is cut.

Meanwhile, the abnormality in which the input circuit in the use state is erroneously set to the operation part 420 may occur, for example, when a builder erroneously inputs a setting value different from the original setting value "1" in a state in which the ambient temperature sensor 500 is connected to the input terminal T1 of the input circuit 113 in the use state.

The CPU 111 reports the abnormality using the remote controller 400 when the abnormality related to the operation of setting the input circuit in the use state is detected through the diagnosis. For example, the information showing the abnormality can be visually displayed on the display part 410 of the remote controller 400. In addition, instead of such a visual report or along with the visual report, it is also possible to auditorily report information showing an abnormality such as sounding an alarm or the like.

Next, a diagnosis operation of an abnormality in the CPU 111 will be described with reference to FIG. 5A and FIG. 5B.

Figure 5A:
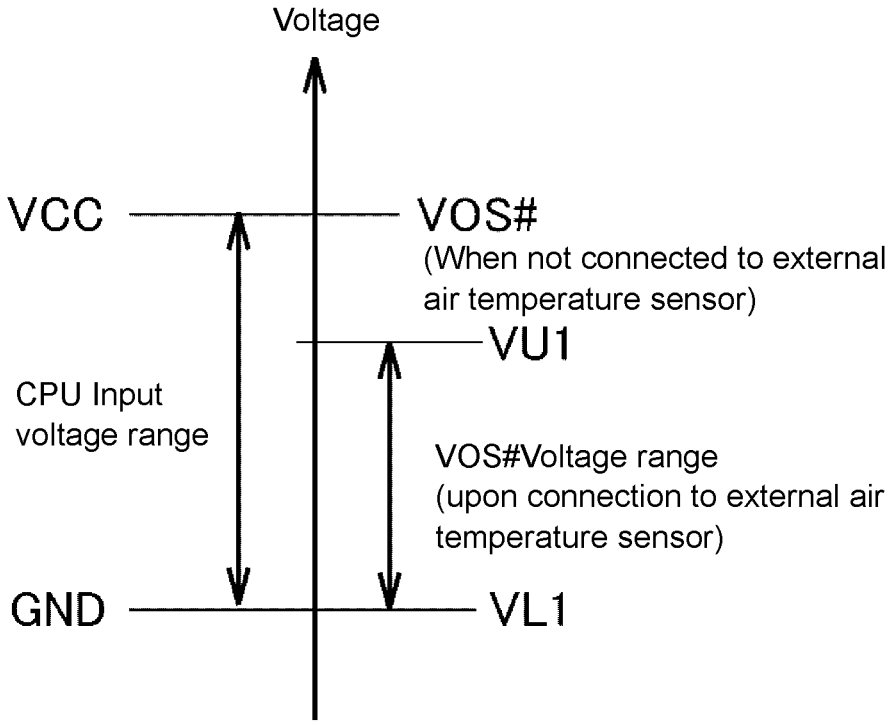
FIG. 5A and FIG. 5B are view for explaining voltage information input to each input port of a CPU.

FIG. 5A shows the voltage information VOS # input to the input port P1 of the CPU 111. Referring to FIG. 5A, a voltage range that can be input to the CPU 111 has the power supply voltage VCC as an upper limit value, and a grounding voltage GND as a lower limit value.

Since the voltage information VOS of the ambient temperature sensor 500 has a voltage range, the voltage information VOS # also has a voltage range. The input circuit 113 is configured such that the voltage range of the voltage information VOS # is reduced to be narrower than the voltage range that can be input to the CPU 111 through voltage conversion.

In the embodiment, the input circuit 113 converts an upper limit value VU1 of the voltage range of the voltage information VOS # into a voltage value lower than that of the power supply voltage VCC. Meanwhile, the input circuit 113 converts a lower limit value VL1 of the voltage range of the voltage VOS # into a voltage value equal to the grounding voltage GND.

Meanwhile, in the input circuit 113, when the ambient temperature sensor 500 is not connected to the input terminal T1, the node N1 is pulled up to the power supply voltage VCC by the resistance element R1. Accordingly, the voltage VOS # input to the input port P1 of the CPU 111 is represented by VOS #=VCC.

Figure 5B:
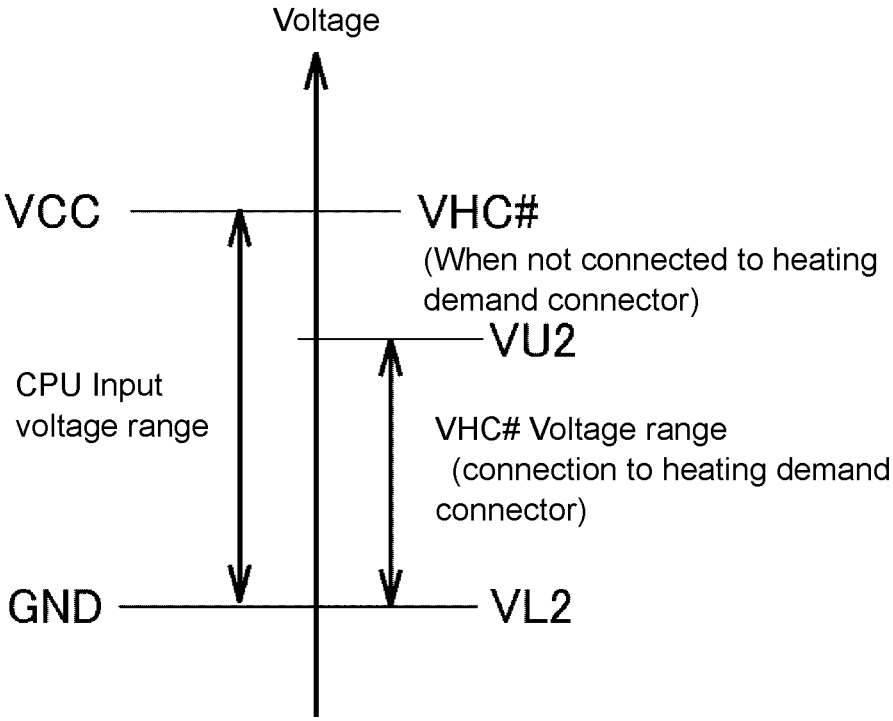

FIG. 5B shows the voltage information VHC # input to the input port P2 of the CPU 111. Referring to FIG. 5B, since the voltage information VHC of the heating demand connector 520 has a voltage range, the voltage information VHC # also has a voltage range. The input circuit 114 is configured such that the voltage range of the voltage information VHC # is reduced to be narrower than the voltage range that can be input to the CPU 111 through voltage conversion.

In the embodiment, the input circuit 114 converts an upper limit value VU2 of the voltage range of the voltage information VHC # into a voltage value lower than the power supply voltage VCC. Meanwhile, the input circuit 114 converts a lower limit value VL2 of the voltage range of the voltage information VHC # into a voltage value equal to the grounding voltage GND.

Meanwhile, in the input circuit 114, when the heating demand connector 520 is not connected to the input terminal T2, the node N2 is pulled up to the power supply voltage VCC by the resistance element R4. Accordingly, the input voltage VHC # to the input port P2 of the CPU 111 is represented by VHC #=VCC.

The CPU 111 can determine whether the ambient temperature sensor 500 is connected to the input terminal T1 on the basis of the voltage information VOS # input to the input port P1. Specifically, when the voltage information VOS # satisfies VL1≤VOS #<VCC, the CPU 111 determines that the ambient temperature sensor 500 is connected to the input terminal T1. Meanwhile, when the voltage information VOS # satisfies VOS #=VCC, the CPU 111 determines that the ambient temperature sensor 500 is not connected to the input terminal T1.

The CPU 111 can determine whether the heating demand connector 520 is connected to the input terminal T2 on the basis of the voltage information VHC # input to the input port P2. Specifically, when the voltage information VHC # satisfies VL2≤VHC #<VCC, the CPU 111 determines whether the heating demand connector 520 is connected to the input terminal T2. Meanwhile, when the voltage information VHC # satisfies VHC #=VCC, the CPU 111 determines that the heating demand connector 520 is not connected to the input terminal T2.

The CPU 111 detects a pattern generally showing connection/non-connection to the input terminals T1 and T2 as a whole by summing a determination result of connection/non-connection to the input terminal T1 and a determination result of connection/non-connection to the input terminal T2.

FIG. 6 shows a pattern detected by the CPU 111. Referring to FIG. 6, connection/non-connection to the input terminals T1 and T2 as a whole can be divided into four patterns.

"Non-connection" represents a state in which the ambient temperature sensor 500 is not connected to the input terminal T1 and the heating demand connector 520 is not connected to the input terminal T2. "Connection to the ambient temperature sensor" represents a state in which the ambient temperature sensor 500 is connected to the input terminal T1 and the heating demand connector 520 is not connected to the input terminal T2. "Connection to the heating demand connector" represents a state in which the ambient temperature sensor 500 is not connected to the input terminal T1 and the heating demand connector 520 is connected to the input terminal T2. "Connection to the ambient temperature sensor and the heating demand connector" represents a state in which the ambient temperature sensor 500 is connected to the input terminal T1 and the heating demand connector 520 is connected to the input terminal T2.

The CPU 111 diagnoses presence of an abnormality related to the operation of setting the input circuit that is in the use state by checking a detected pattern and the terminal setting information when it is detected which pattern of the four patterns shown in FIG. 6 a connection state of the input terminals T1 and T2 as a whole corresponds to. The CPU 111 further reports a diagnostic result using the display part 410 and an LED 430 of the remote controller 400.

FIG. 7 shows an aspect of a report of a diagnostic result by the CPU 111. Referring to FIG. 7, in a state in which the operation switch of the heating heat-source apparatus 100 is turned on (an operation on state), in each of combinations of three pieces of terminal setting information (the setting values 1, 2 and 3) and four detection patterns (12 ways in total), presence of a light state and an error report of the LED 430 is shown.

Specifically, when the terminal setting information is the setting value "1 (dc)," the CPU 111 causes the LED 430 to flicker in any one pattern of "non-connection," "connection to the ambient temperature sensor," "connection to the heating demand connector" and "connection to the ambient temperature sensor and the heating demand connector." A user can determine that neither the ambient temperature sensor 500 nor the heating demand connector 520 is connected to the controller 110 and it coincides with the terminal setting information through flickering of the LED 430.

On the other hand, when the terminal setting information is the setting value "2 (OS)," the CPU 111 reports an error while causing the LED 430 to flicker in the case of the patterns of "non-connection" and "connection to the heating demand connector." A user can determine that the ambient temperature sensor 500 set to the use state is not connected to the controller 110 through flickering and an error report of the LED 430.

Meanwhile, in the case of "connection to the ambient temperature sensor" and "connection to the ambient temperature sensor and the heating demand connector," the CPU 111 causes the LED 430 light up. A user can determine that the ambient temperature sensor 500 set to the use state is connected to the controller 110 through lighting of the LED 430.

Further, in the case of the pattern of "connection to the ambient temperature sensor and the heating demand connector," both of the voltage information VOS # and VHC # are input to the CPU 111. In this case, the CPU 111 can select and use the voltage information VOS # of the ambient temperature sensor 500 on the basis of the setting value "2 (OS)."

In addition, when the terminal setting information is the setting value "3 (HC)," the CPU 111 reports an error (abnormality) while causing the LED 430 to flicker in the case of the patterns of "non-connection" and "connection to the ambient temperature sensor." A user can determine that the heating demand connector 520 set to the use state is not connected to the controller 110 through flickering and an error report of the LED 430.

On the other hand, in the case of the patterns of "connection to the heating demand connector" and "connection to the ambient temperature sensor and the heating demand connector," the CPU 111 causes the LED 430 to light up and flicker according to the voltage value of the voltage information VHC #. Specifically, while the CPU 111 causes the LED 430 to light up when the voltage value of the voltage information VHC # is a predetermined threshold value or more, the CPU 111 causes the LED 430 to flicker when the voltage information VHC # is less than the predetermined threshold value. Further, the predetermined threshold value is set to a target value of a heating temperature when the ambient temperature is high and a heating operation is substantially not demanded. Accordingly, a user can determine that the heating demand connector 520 does not demand a heating operation while the heating demand connector 520 set to the use state is connected to the controller 110 through flickering of the LED 430.

Further, in the case of the state in which the operation switch of the heating heat-source apparatus 100 is turned off (an operation off state), the CPU 111 turns off the LED 430 in any pattern.

An aspect of the report shown in FIG. 7 is previously stored in the memory 112 of the controller 110 as a table 112*a* (FIG. 3). The CPU 111 can visually and/or auditorily report an abnormality using the remote controller 400 while causing the LED 430 to light up according to the terminal setting information and the detected pattern by referring to the table 112*a*.

Figure 8:
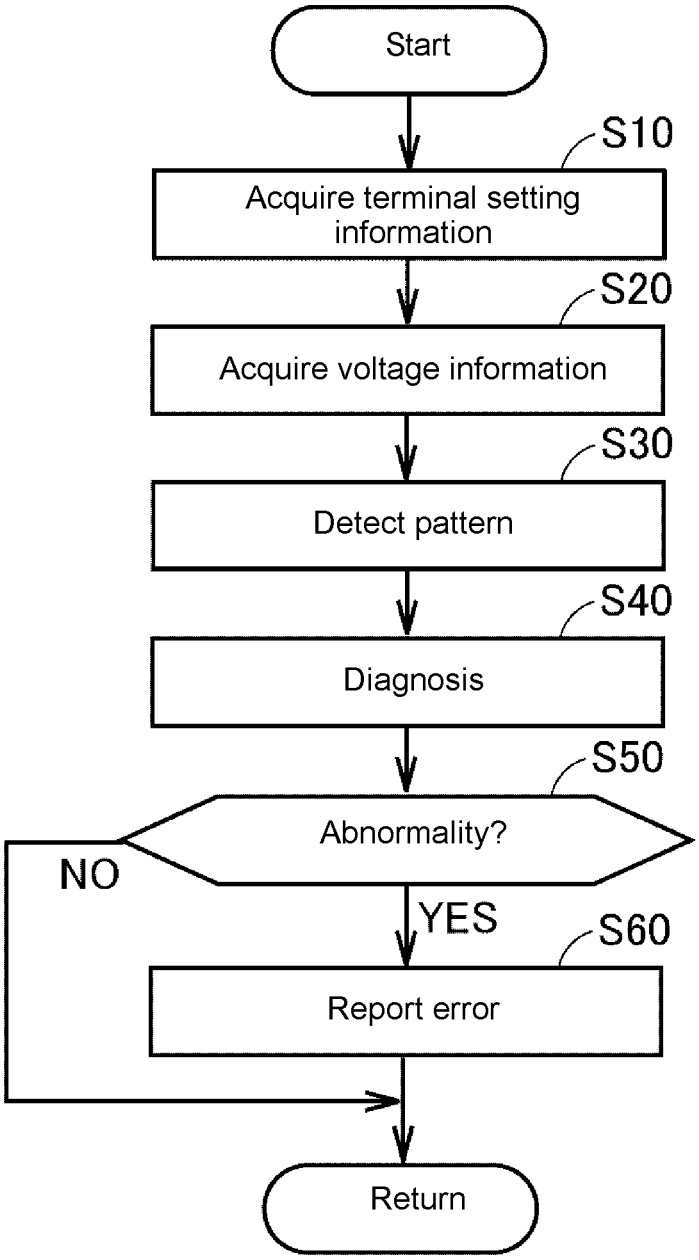
FIG. 8 is a flowchart showing a processing sequence of a diagnosis operation and a reporting operation by the controller.

FIG. 8 shows a flowchart showing a processing sequence of a diagnosis operation and a reporting operation in the controller 110.

Referring to FIG. 8, the controller 110 acquires the terminal setting information transmitted from the remote controller 400 in step S10.

The controller 110 further receives the heating demand information (the voltage information VOS) from the ambient temperature sensor 500 and the heating demand information (the voltage information VHC) from the heating demand connector 520 in the input circuits 113 and 114 in step S20, respectively. The voltage information VOS is converted into the voltage information VOS # by the input circuit 113 and input to the input port P1 of the CPU 111. The voltage information VHC is converted into the voltage information VHC # by the input circuit 114 and input to the input port P2 of the CPU 111.

The controller 110 can determine whether the ambient temperature sensor 500 is connected to the input terminal T1 and whether the heating demand connector 520 is connected to the input terminal T2 on the basis of the voltage information VOS # and VHC # in step S30. Then, the controller 110 detects a pattern that represents connection/non-connection to the input terminals T1 and T2 on the basis of the table shown in FIG. 6.

The controller 110 goes to processing of step S40 and diagnoses whether there is no abnormality related to an operation of setting the input circuit that is in the use state on the basis of the terminal setting information acquired in step S10 and a pattern detected in step S30. The controller 110 diagnoses presence of an abnormality with reference to the table 112*a* shown in FIG. 7.

When an abnormality related to an operation of setting the input circuit that is in the use state is detected (upon determination of YES in S50), the controller 110 reports an error using the remote controller 400 in step S60. Meanwhile, when the abnormality is not detected (upon determination of NO in S50), the controller 110 does not perform the report in step S60.

In this way, according to the heating heat-source apparatus of the embodiment, in the heating heat-source apparatus having a plurality of input circuits configured to receive a plurality of pieces of mutually independent heating demand information, it is possible to detect and report an abnormality related to an operation of setting one input circuit of the plurality of input circuits to a use state.

Figure 9A:
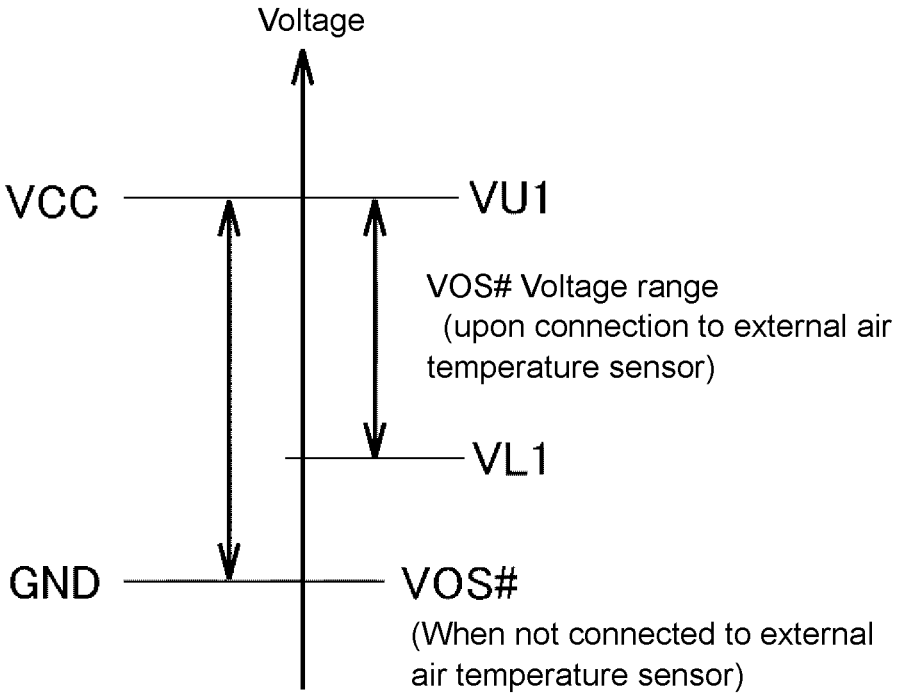
FIG. 9A and FIG. 9B are view for explaining a modified example of voltage information input to each input port of the CPU.
Figure 9B:
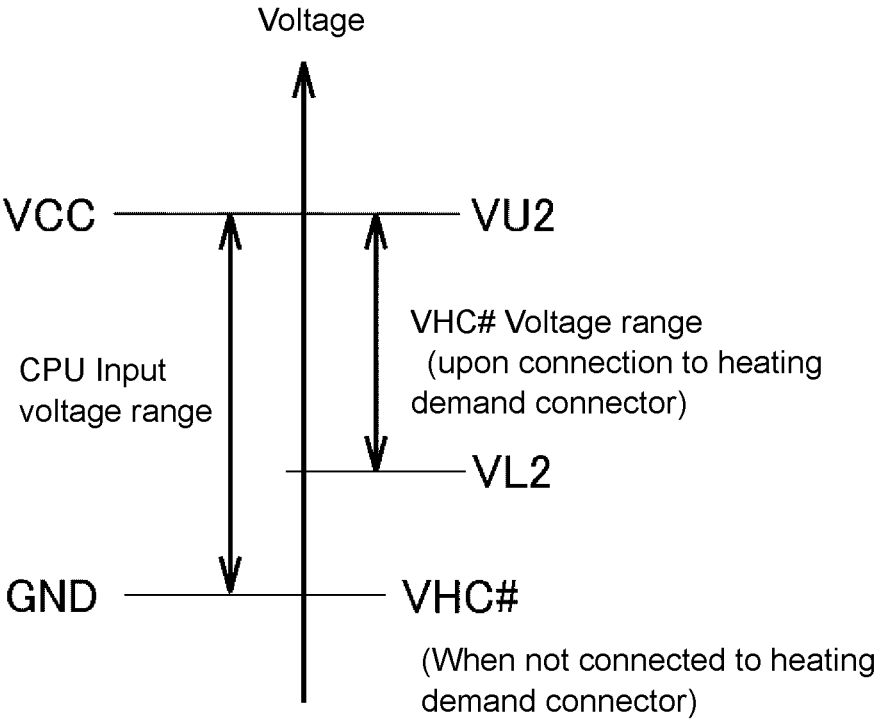

Further, in the heating heat-source apparatus according to the embodiment, in each of the plurality of input circuits, while the voltage range of the voltage information that is the heating demand information is reduced to be narrower than the voltage range that can be input to the CPU 111, when the voltage information is not input, the voltage value that is inside the voltage range that can be input to the CPU 111 and outside the voltage range of the voltage information is output to the CPU 111. Accordingly, while the configuration in which each of the input circuits converts the upper limit value of the voltage range of the voltage information into the voltage value lower than an upper limit value (power supply voltage VCC) of the voltage range that can be input to the CPU 111, and when the voltage information is not input, the voltage value equal to the upper limit value (power supply voltage VCC) of the voltage range that can be input to the CPU 111 is output to the CPU 111 as shown in FIG. 5A and FIG. 5B has been described in the above-mentioned embodiment, as shown in FIG. 9A and FIG. 9B, a configuration in which each of the input circuits converts the lower limit value of the voltage range of the voltage information into the voltage value higher than a lower limit value (grounding voltage GND) of the voltage range that can be input to the CPU 111, and when the voltage information is not input, the voltage value equal to the lower limit value (grounding voltage GND) of the voltage range that can be input to the CPU 111 is output to the CPU 111 may be provided. In the above-mentioned configuration, the CPU 111 can determine whether the ambient temperature sensor 500 and the heating demand connector 520 are connected to the input terminals T1 and T2, respectively, on the basis of the voltage information.

It will be apparent to those skilled in the art that various modifications and variations can be made to the disclosed embodiments without departing from the scope or spirit of the disclosure. In view of the foregoing, it is intended that the disclosure cover modifications and variations provided that they fall within the scope of the following claims and their equivalents.

What is claimed is:

1. A heating heat-source apparatus, comprising:

a heating structure configured to heat a thermal medium;

a heating circulating path configured to circulate the thermal medium heated by the heating structure between a heating terminal and the heating heat-source apparatus upon performance of a heating operation;

a plurality of input circuits configured to receive a plurality of pieces of heating demand information independent of each other;

a setting part configured to set one input circuit of the plurality of input circuits to a use state;

a control part configured to control the heating structure on the basis of heating demand information from the input circuit in the use state while receiving specified information for specifying the input circuit in the use state set by the setting part; and a reporting part, wherein each of the plurality of pieces of heating demand information is provided to the corresponding input circuit as voltage information having a predetermined voltage range, each of the plurality of input circuits is configured to output a voltage value based on the provided voltage information to the control part, and the control part reports an abnormality using the reporting part when the voltage value output from the input circuit in the use state deviates from an output voltage range output by the input circuit specified in the specified information, wherein each of the plurality of input circuits comprises a conversion circuit configured to convert the voltage information into a voltage that is able to be input to the control part and output the converted voltage to the control part, the conversion circuit is configured such that the predetermined voltage range of the voltage information is reduced to be narrower than a voltage range that is able to be input to the control part, and when the voltage information is not input, a voltage value inside the voltage range that is able to be input to the control part and outside the output voltage range is output to the control part.

2. The heating heat-source apparatus according to claim 1, wherein the abnormality comprises:

an abnormality in which the heating demand information is not input to the input circuit in the use state; and an abnormality in which the input circuit in the use state is erroneously set by the setting part.

3. The heating heat-source apparatus according to claim 1, wherein the conversion circuit is configured such that an upper limit value of the predetermined voltage range of the voltage information is converted into a voltage value that is lower than the upper limit value of the voltage range that is able to be input to the control part, and when the voltage information is not input, a voltage value equal to the upper limit value of the voltage range that is able to be input to the control part is output to the control part.

4. The heating heat-source apparatus according to claim 2, wherein the conversion circuit is configured such that an upper limit value of the predetermined voltage range of the voltage information is converted into a voltage value that is lower than the upper limit value of the voltage range that is able to be input to the control part, and when the voltage information is not input, a voltage value equal to the upper limit value of the voltage range that is able to be input to the control part is output to the control part.

5. The heating heat-source apparatus according to claim 1, wherein the conversion circuit is configured such that a lower limit value of the predetermined voltage range of the voltage information is converted into a voltage value higher than the lower limit value of the voltage range that is able to be input to the control part, and when the voltage information is not input, a voltage value equal to the lower limit value of the voltage range that is able to be input to the control part is output to the control part.

6. The heating heat-source apparatus according to claim 2, wherein the conversion circuit is configured such that a lower limit value of the predetermined voltage range of the voltage information is converted into a voltage value higher than the lower limit value of the voltage range that is able to be input to the control part, and when the voltage information is not input, a voltage value equal to the lower limit value of the voltage range that is able to be input to the control part is output to the control part.

7. A control method of a heating heat-source apparatus, the heating heat-source apparatus comprising:

a heating structure configured to heat a thermal medium;

a heating circulating path configured to circulate the thermal medium heated by the heating structure between a heating terminal and the heating heat-source apparatus upon performance of a heating operation;

a plurality of input circuits configured to receive a plurality of pieces of heating demand information independent of each other;

a setting part configured to set one input circuit among the plurality of input circuits to a use state;

a control part configured to control the heating structure on the basis of heating demand information from the input circuit in the use state while receiving specified information for specifying the input circuit in the use state set by the setting part, wherein each of the plurality of pieces of heating demand information is provided to the corresponding input circuit as voltage information having a predetermined voltage range, and each of the plurality of input circuits is configured to output a voltage value based on the provided voltage information to the control part, the control method comprising:

receiving the voltage value transmitted from the input circuit in the use state;

receiving specified information for specifying the input circuit in the use state from the setting part; and reporting an abnormality when the voltage value transmitted from the input circuit in the use state deviates from an output voltage range output by the input circuit specified in the specified information, wherein each of the plurality of input circuits comprises a conversion circuit configured to convert the voltage information into a voltage that is able to be input to the control part and output the converted voltage to the control part, the conversion circuit is configured such that the predetermined voltage range of the voltage information is reduced to be narrower than a voltage range that is able to be input to the control part, and when the voltage information is not input, a voltage value inside the voltage range that is able to be input to the control part and outside the output voltage range is output to the control part.

* * * * *